US008976213B2

(12) United States Patent
Otoshi

(10) Patent No.: US 8,976,213 B2
(45) Date of Patent: Mar. 10, 2015

(54) IMAGE FORMING APPARATUS AND CONTROL METHOD THEREOF

(71) Applicant: Canon Kabushiki Kaisha, Tokyo (JP)

(72) Inventor: Tatsuya Otoshi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 13/875,882

(22) Filed: May 2, 2013

(65) Prior Publication Data

US 2013/0300813 A1 Nov. 14, 2013

(30) Foreign Application Priority Data

May 11, 2012 (JP) ..... 2012-109927

(51) Int. Cl.

| | |
|---|---|
| ***B41J 11/66*** | (2006.01) |
| ***B41J 11/70*** | (2006.01) |
| ***B41J 11/00*** | (2006.01) |
| ***B41J 11/42*** | (2006.01) |
| ***B41J 15/04*** | (2006.01) |

(52) U.S. Cl.

CPC ..... *B41J 11/0005* (2013.01); *B41J 11/0095* (2013.01); *B41J 11/42* (2013.01); *B41J 11/70* (2013.01); *B41J 15/04* (2013.01)

USPC ..... 347/218

(58) Field of Classification Search

USPC ..... 347/218; 400/621

See application file for complete search history.

(56) References Cited

U.S. PATENT DOCUMENTS

| | | | | |
|---|---|---|---|---|
| 8,780,859 | B2 * | 7/2014 | Damenti | 370/331 |
| 2009/0297246 | A1 * | 12/2009 | Nakai et al. | 400/621 |
| 2013/0100219 | A1 * | 4/2013 | Tokisawa et al. | 347/102 |

FOREIGN PATENT DOCUMENTS

JP 2008-137226 A 6/2008

* cited by examiner

*Primary Examiner* — Huan Tran

(74) *Attorney, Agent, or Firm* — Cowan, Liebowitz & Latman, P.C.

(57) ABSTRACT

An apparatus comprises an accommodation unit which accommodates a continuous printing sheet; a conveyance unit which conveys the printing sheet; a printing unit which performs image forming processing on the conveyed printing sheet; a cutting unit which cuts the printing sheet after completion of the image forming processing; and a processing unit which executes, when a printing sheet remaining on a conveyance path is detected, processing for removing the remaining printing sheet, the processing unit controls the conveyance unit to convey the printing sheet to detect a leading end, compares a first distance from the leading end to a portion located at a curl correction unit with a second distance from the leading end, which distance is required for image forming processing set, and sets a larger distance as a cutting position of the remaining printing sheet.

19 Claims, 12 Drawing Sheets

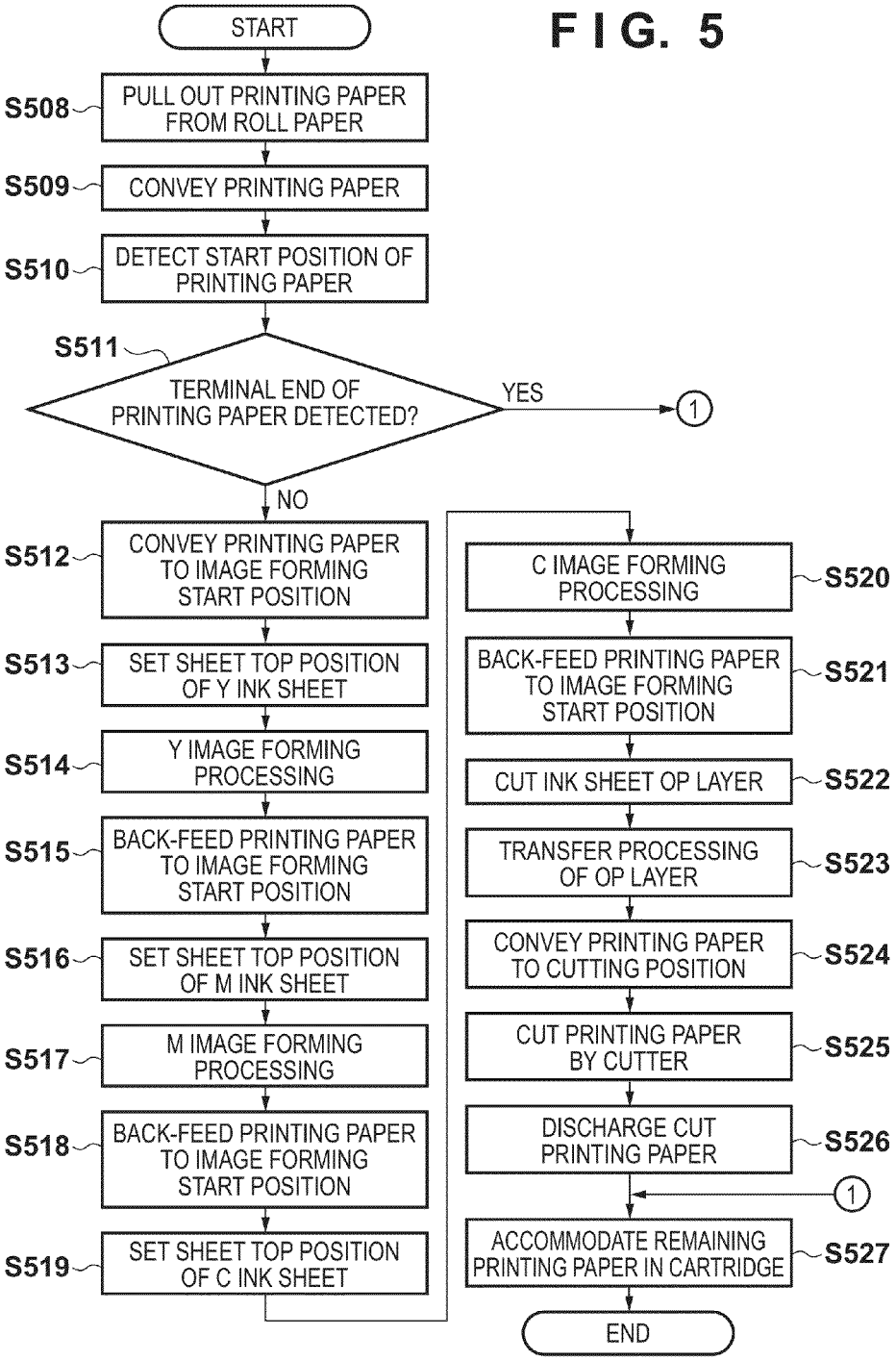
FIG. 5
START
S508
PULL OUT PRINTING PAPER FROM ROLL PAPER
S509
CONVEY PRINTING PAPER
S510
DETECT START POSITION OF PRINTING PAPER
S511
TERMINAL END OF PRINTING PAPER DETECTED?
YES
1
NO
S512
CONVEY PRINTING PAPER TO IMAGE FORMING START POSITION
S513
SET SHEET TOP POSITION OF Y INK SHEET
S514
Y IMAGE FORMING PROCESSING
S515
BACK-FEED PRINTING PAPER TO IMAGE FORMING START POSITION
S516
SET SHEET TOP POSITION OF M INK SHEET
S517
M IMAGE FORMING PROCESSING
S518
BACK-FEED PRINTING PAPER TO IMAGE FORMING START POSITION
S519
SET SHEET TOP POSITION OF C INK SHEET
C IMAGE FORMING PROCESSING
S520
BACK-FEED PRINTING PAPER TO IMAGE FORMING START POSITION
S521
CUT INK SHEET OP LAYER
S522
TRANSFER PROCESSING OF OP LAYER
S523
CONVEY PRINTING PAPER TO CUTTING POSITION
S524
CUT PRINTING PAPER BY CUTTER
S525
DISCHARGE CUT PRINTING PAPER
S526
1
ACCOMMODATE REMAINING PRINTING PAPER IN CARTRIDGE
S527
END

IMAGE FORMING APPARATUS AND CONTROL METHOD THEREOF

BACKGROUND OF THE INVENTION

1. Field of the Invention

The present invention relates to an image forming apparatus which performs an image forming operation on continuous printing sheet wound in a roll shape, and a control method thereof.

2. Description of the Related Art

Currently, a roll paper printer which performs an image forming operation on continuous printing paper wound in a roll shape (roll paper) has merits of high degrees of freedom in an output size (image forming length), low cost of roll paper, and the like. On the other hand, in the roll paper printer, since a curl unique to the roll paper is required to be removed, a printer engine includes a curl correction unit. In the roll paper printer, since the curl correction unit forms a curl in an opposing direction during the image forming operation, the curl unique to the roll paper is removed. The image-forming processed printing paper, the curl of which has been removed by the curl correction unit, is cut by a cutter and is discharged outside the printer, while the remaining paper is rolled up and stored in a cartridge.

When an electric power failure, forced termination, battery dead state, or the like has occurred during the image forming operation of the roll paper printer, and a power supply is stopped, paper in the middle of the image forming operation may remain in the printer engine. When a power supply is turned on again from this state, an image forming operation may be unwantedly restarted from a position on the paper in the middle of the image forming operation. When the image forming operation is restarted from the position on the paper in the middle of the image forming operation, not only image forming quality impairs, but also a peeling error of an ink sheet occurs in case of a thermal transfer printer, thereby causing jamming of the paper and ink sheet.

In order to prevent such problems, when the paper remains in the printer engine upon power-ON, processing for discharging the remaining paper is executed.

For example, Japanese Patent Laid-Open No. 2008-137226 describes that a roll paper printer includes a storage unit which stores an image forming status, a previous image forming status is referred to from image forming statuses stored in the storage unit upon power-ON, and when the previous image forming status indicates that the previous image forming operation was incomplete, printing paper is cut by a maximum image forming length based on the length of an ink sheet and is discharged.

The roll paper printer normally includes the curl correction unit used to correct a roll-shaped curl. When the curl correction unit holds paper for a predetermined time period or longer, a curl in the opposing direction is locally formed on the paper. When an image forming operation is performed using the paper with such curl, not only the local curl remains on the paper, but also image forming quality on a curl region lowers.

Since Japanese Patent Laid-Open No. 2008-137226 adopts the method of clipping printing paper by the maximum image forming length based on the length of the ink sheet, the paper may be clipped before the curl region.

By contrast, when paper is cut by adding a length from an image forming unit such as a thermal head to the curl correction unit to the maximum image forming length, a portion formed with the curl can be removed, thereby solving the above problem.

However, when the paper is cut by adding the length from the image forming unit to the curl correction unit to the maximum image forming length, the paper clipping amount increases, thereby decreasing the number of sheets that can undergo image forming operations.

SUMMARY OF THE INVENTION

The present invention has been made in consideration of the aforementioned problems, and realizes an image forming apparatus which can suppress wasteful use of sheet and deterioration of image forming quality in remaining sheet processing at an activation timing, and a control method thereof.

In order to solve the aforementioned problems, the present invention provides an image forming apparatus comprising: an accommodation unit configured to accommodate a continuous printing sheet wound in a roll shape; a conveyance unit configured to pull out and convey the printing sheet from the accommodation unit; a printing unit configured to perform image forming processing on the printing sheet which is conveyed by the conveyance unit to an image forming start position; a cutting unit configured to cut the printing sheet after completion of the image forming processing at a predetermined cutting position; and a processing unit configured to execute, when a printing sheet remaining on a conveyance path is detected at an activation timing, processing for removing the remaining printing sheet, wherein the processing unit controls the conveyance unit to convey the printing sheet at the activation timing to detect a leading end, compares a first distance from the leading end to a portion which was located at a curl correction unit before the activation with a second distance from the leading end, which distance is required for image forming processing set before the activation, and sets a larger distance as a cutting position of the remaining printing sheet.

In order to solve the aforementioned problems, the present invention provides a control method of an image forming apparatus having: an accommodation unit configured to accommodate a continuous printing sheet wound in a roll shape; a conveyance unit configured to pull out and convey the printing sheet from the accommodation unit; a printing unit configured to perform image forming processing on the printing sheet which is conveyed by the conveyance unit to an image forming start position; and a cutting unit configured to cut the printing sheet after completion of the image forming processing at a predetermined cutting position, the method comprising: a remaining sheet processing step of executing, when a printing sheet remaining on a conveyance path is detected at an activation timing, processing for removing the remaining printing sheet, wherein in the remaining sheet processing step, the conveyance unit is controlled to convey the printing sheet at the activation timing to detect a leading end, a first distance from the leading end to a portion which was located at a curl correction unit before the activation is compared with a second distance from the leading end, which distance is required for image forming processing set before the activation, and a larger distance is set as a cutting position of the remaining printing sheet.

According to the present invention, wasteful use of sheet and deterioration of image forming quality can be suppressed in remaining sheet processing at an activation timing.

Further features of the present invention will become apparent from the following description of exemplary embodiments (with reference to the attached drawings).

BRIEF DESCRIPTION OF THE DRAWINGS

FIG. 5 is a flowchart showing image forming processing by the thermal printer according to the embodiment;

DESCRIPTION OF THE EMBODIMENTS

A mode for carrying out the present invention will be described in detail hereinafter. Note that an embodiment to be described hereinafter is an example required to implement the present invention and should be modified or changed as needed depending on configurations of apparatus and various conditions to which the present invention is applied, and the present invention is not limited to the following embodiment. Some of embodiments to be described later may be combined as needed.

Note that in the following description, "printing" indicates a series of overall operations from an image forming operation based on a printing instruction from the user until a paper discharge operation. Also, "image forming" indicates an operation for recording an image on a printing medium such as printing paper by thermally transferring an ink applied on an ink sheet to the printing paper of the print operations. Also, continuous printing paper wound in a roll shape will be referred to as roll paper hereinafter.

An image forming apparatus and method using a thermal transfer or dye sublimation thermal printer will be described hereinafter. However, the present invention is not limited to a printer alone, but is applicable to, for example, a copying machine, facsimile apparatus, computer system, and the like as long as they include apparatuses having an image forming function of this embodiment. Also, the printing paper of the present invention includes not only that of a paper material, but also sheet members such as plastic films made up of other materials.

<Apparatus Configuration>

A principal configuration of a thermal printer of this embodiment will be described below with reference to FIG. 1.

Figure 1:
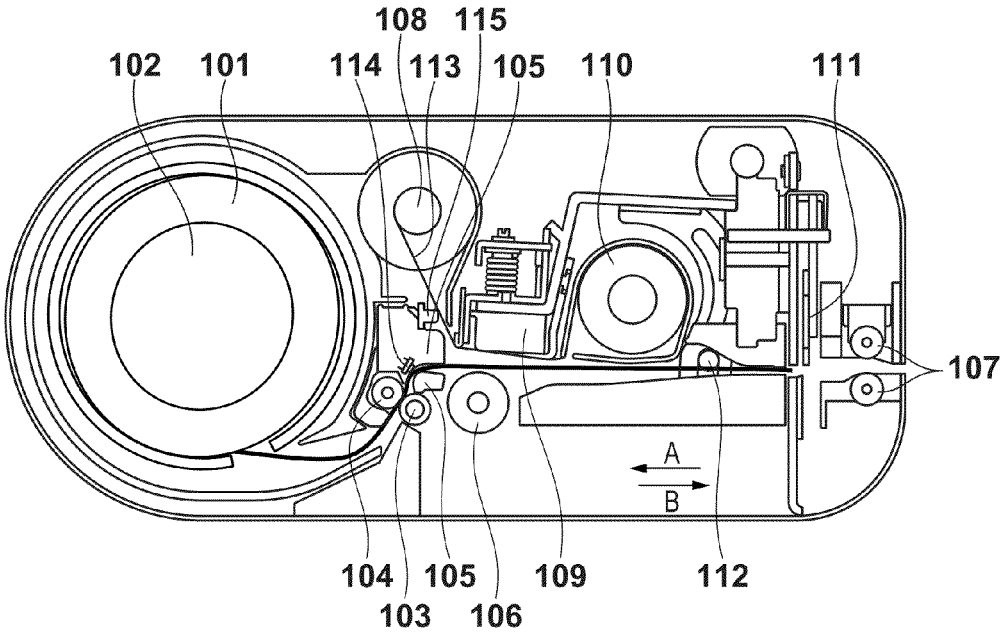
FIG. 1 is a sectional view showing the arrangement of a printer engine of a thermal printer according to an embodiment.

Referring to FIG. 1, roll paper 101 is accommodated in a printer main body to be rotatable via a roll paper shaft 102. Printing paper 112 pulled out from the roll paper 101 is pinched between a grip roller 103 and a pinch roller 104, which is disposed at its opposite position, is fed onto a conveyance path, and is reciprocally conveyed in directions of arrows A and B during an image forming operation. A plurality of projections are formed on the surface of the grip rollers 103 at predetermined intervals in circumferential and axial directions.

A curl correction unit 105 is arranged on the downstream side of the grip roller 103. The curl correction unit 105 curls the printing paper 112 in a direction opposite to a winding direction of the roll paper 101, thereby correcting a curl of the roll paper. On the downstream side of the curl correction unit 105, a platen roller 106 is arranged. At a position opposite to the platen roller 106, a thermal head 109 is disposed, and an ink sheet 113 passes through a gap between the thermal head 109 and printing paper 112.

The curl correction unit 105 includes a paper detection sensor 114 which detects the leading end of the printing paper 112 conveyed by the grip roller 103. As the paper detection sensor 114, a photoreflector or the like is used.

The ink sheet 113 is fed from a roll bobbin 110 on the ink sheet supply side, and is taken up by an ink-sheet take-up bobbin 108 via a gap between the thermal head 109 and printing paper 112.

A marker detection sensor 115 detects markers applied to leading end portions of respective colors of the ink sheet 113, as will be described later. As the marker detection sensor 115, a photoreflector or the like is used.

A cutter 111 cuts image-forming processed printing paper 112 or printing paper 112 in remaining paper processing (to be described later).

A pair of discharge rollers 107 pinch the leading end of the printing paper 112 to convey the printing paper 112 to an image forming start position, and discharge the printing paper 112 cut by the cutter 111 to the outside of the printer.

<Block Arrangement>

The block arrangement of the thermal printer of this embodiment will be described below with reference to FIG. 2.

Figure 2:
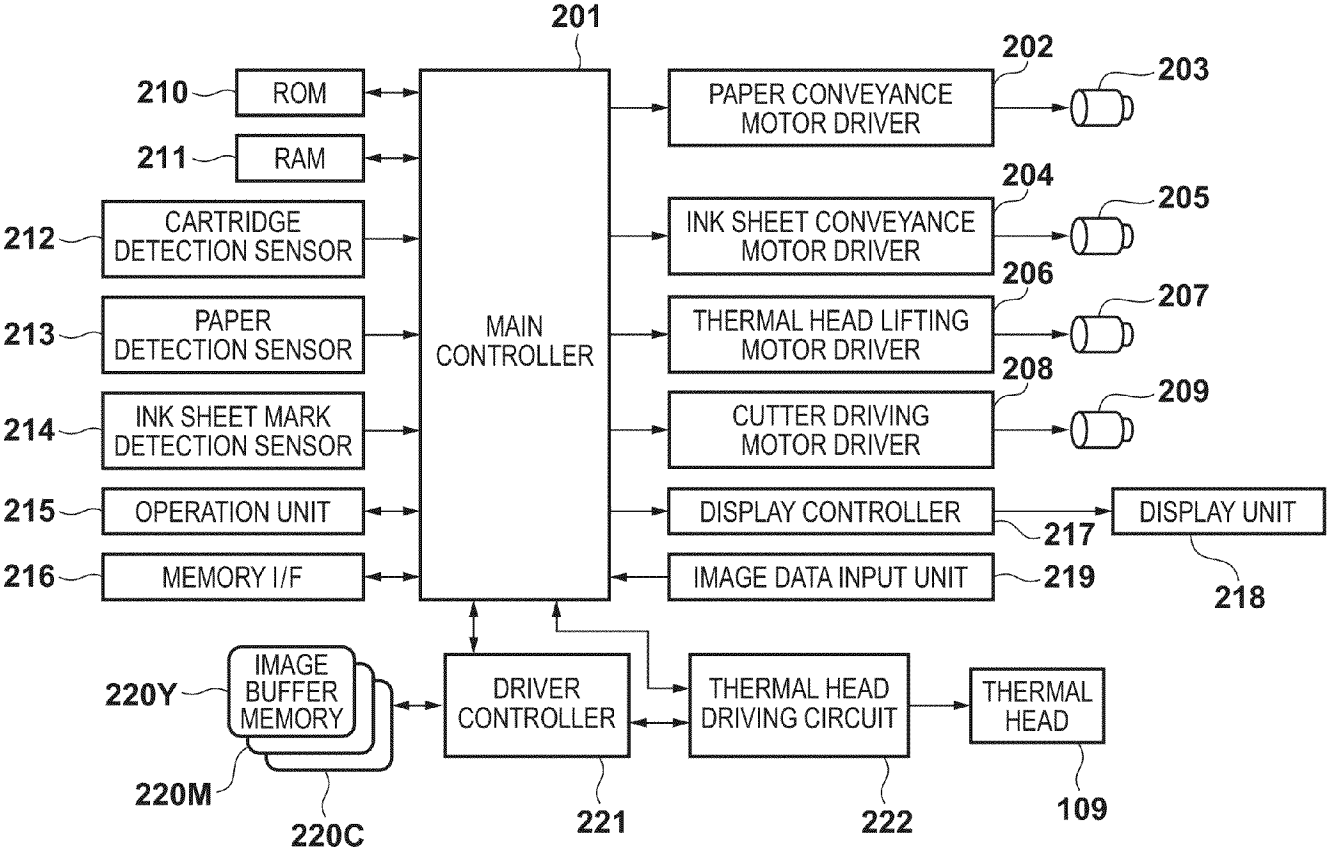
FIG. 2 is a block diagram showing the arrangement of the thermal printer according to the embodiment.

Referring to FIG. 2, a main controller 201 controls the overall thermal printer. The main controller 201 controls the printer according to control programs stored in a ROM 210 and executes calculation processing according to various programs. The main controller 201 also executes, for example, processing for giving modification processing to image data to generate image data required for an image forming operation, and storing the generated image data in a RAM 211. The RAM 211 is also used as a temporary storing area of image data, and work areas of various control programs such as a resize processing program of an image. The ROM 210 stores system control programs and various parameters such as adjustment values.

A paper conveyance motor driver 202 is required to drive a paper conveyance motor 203. The paper conveyance motor 203 is coupled to the roll paper shaft 102, grip roller 103, discharge rollers 107, and the like via a rotation mechanism, and drives these rollers, thereby conveying the printing paper.

An ink sheet conveyance motor driver 204 is required to drive an ink sheet conveyance motor 205. The ink sheet conveyance motor 205 drives the ink-sheet take-up bobbin 108 via a rotation mechanism to take up the used ink sheet 113.

A thermal head lifting motor driver 206 controls rotation of a thermal head lifting motor 207 required to move the thermal head 109 (to be described later) up and down, thereby operating the thermal head 109 between an image forming position and retracted position.

A cutter motor driver 208 controls a cutter motor 209 required to drive the cutter 111, thereby cutting the printing paper.

A cartridge detection sensor 212 determines an attached state of a cartridge used to accommodate roll paper, and types of a plurality of available cartridges. Based on this determination result, image forming processing according to the cartridge is executed according to control programs stored in the ROM 210.

A paper detection sensor 213 is arranged between the grip roller 103 and curl correction unit 105, and detects if the leading end portion of the printing paper 112, which is pulled out from the cartridge at an image forming start timing, has passed through a position behind the grip roller 103. Also, the paper detection sensor 213 detects a to-be-detected portion such as a terminal end hole 701 or terminal end marker 702 of roll paper, as will be described later.

An ink sheet mark detection sensor 214 of the ink sheet, which detects a marker applied to a leading end portion for each color of the ink sheet 113.

A memory I/F 216 is used to write and read out data in and from a memory card or the like, which is attached to the printer.

A display controller 217 controls to display a menu required to input image data to be printed and setting data required for printing on a display unit 218.

An image data input unit 219 fetches image data from an external apparatus such as a PC (Personal Computer), digital camera, or digital television connected to the printer.

Image buffer memories 220Y, 220M, and 220C are used to store image data acquired via the memory I/F 216 or image data input unit 219. A yellow image buffer memory 220Y is used to temporarily store yellow (Y) image data; and 220M and 220C, image buffer memories used to temporarily store magenta (M) and cyan (C) image data, respectively.

A thermal head deriving circuit 222 drives heat generating members incorporated in the thermal head 109. A driver controller 221 connected to the main controller 201 controls the thermal head driving circuit 222 using image data recorded in a bitmap format in the image buffer memories 220Y, 220M, and 220C, thereby attaining an image forming operation.

The main controller 201 converts image data in the image buffer memories 220Y, 220M, and 220C into thermal head driving data, and the driver controller 221 controls the thermal head driving circuit 222 according to the thermal head driving data, thereby attaining an image forming operation.

<Operation Until Image Forming Start Timing>

Figure 3:
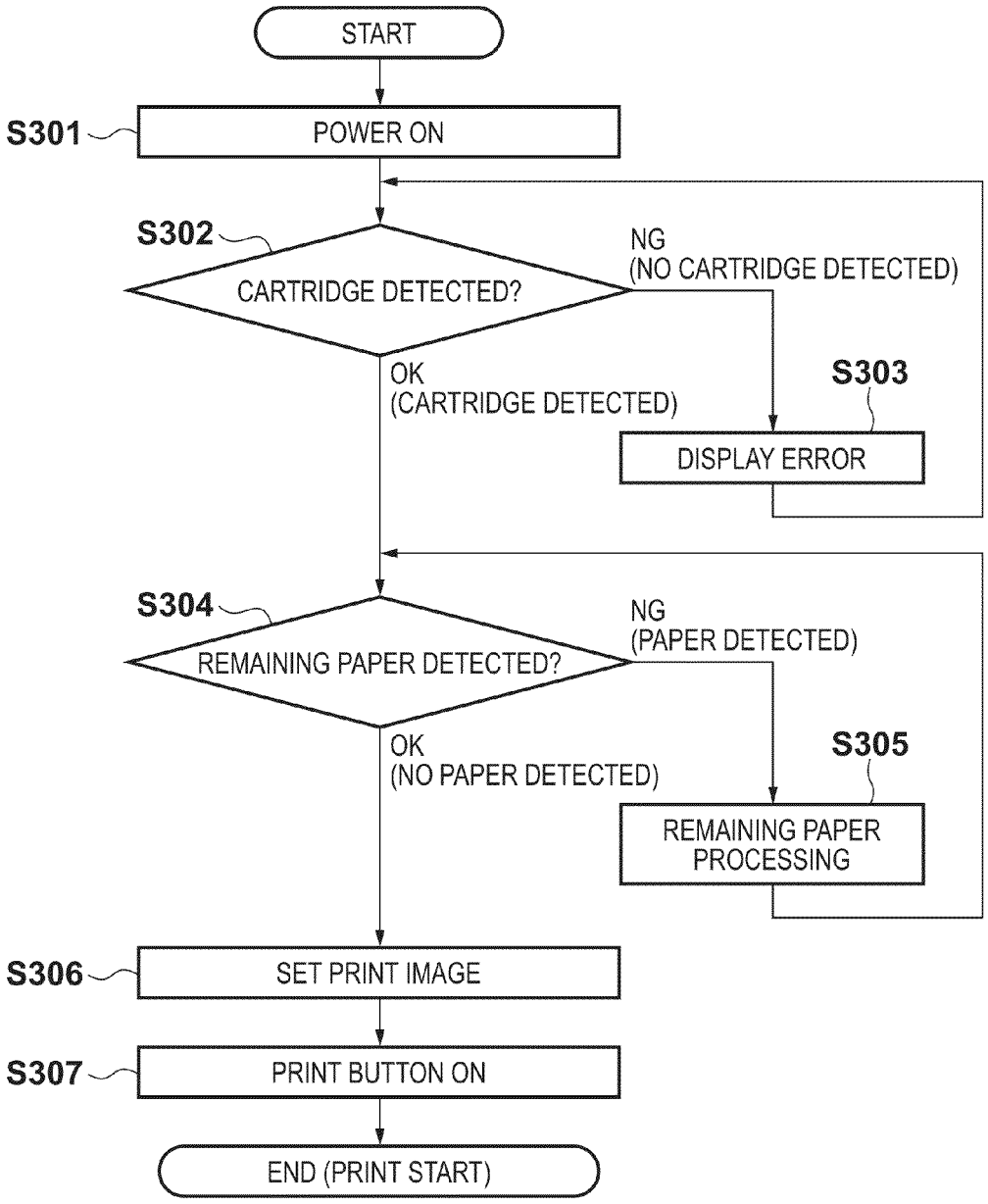
FIG. 3 is a flowchart showing processing from an activation timing until an image forming start timing of the thermal printer according to the embodiment.
Figure 4:
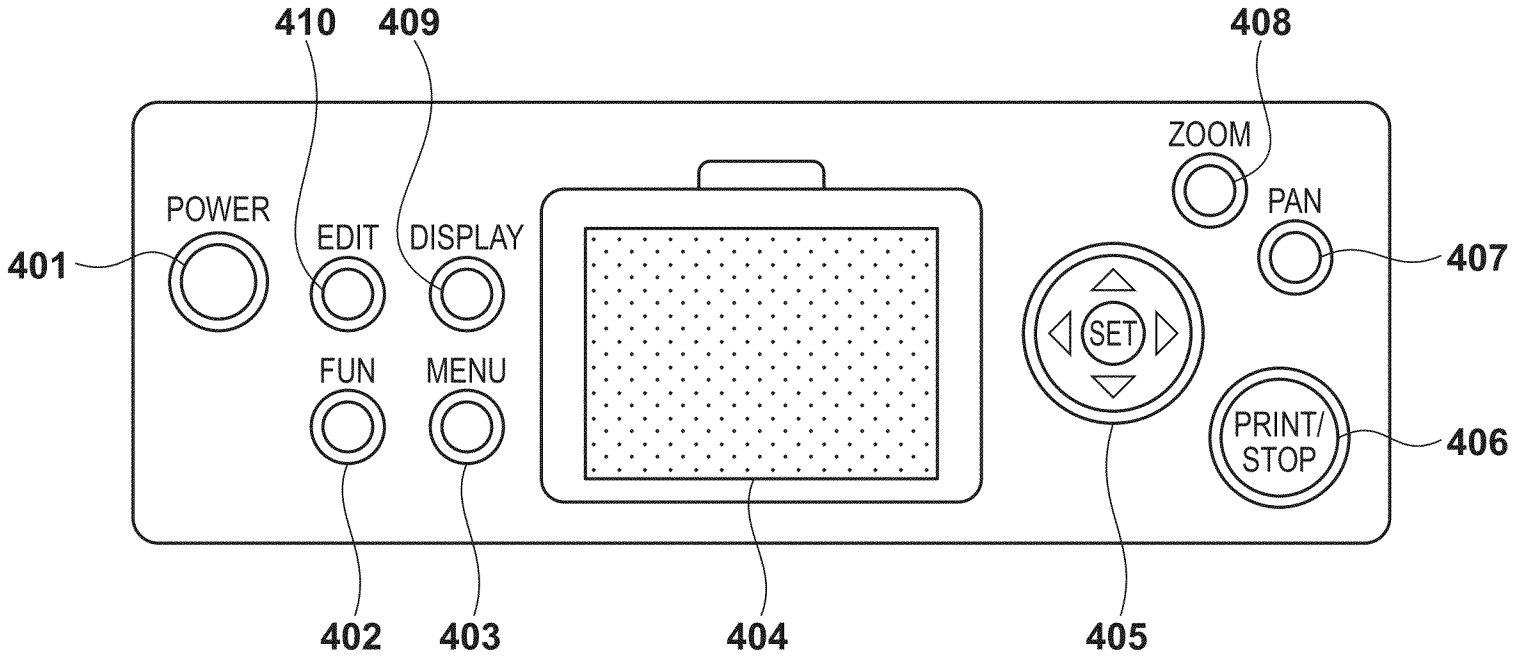
FIG. 4 is a view showing the outer appearance of an operation unit of the thermal printer according to the embodiment.

Operations from an activation (power-ON) timing until an image forming start timing of the thermal printer according to this embodiment will be described below with reference to FIGS. 3 and 4. Note that FIG. 3 is a flowchart showing operations until the image forming start timing of the thermal printer according to this embodiment. Processing of this flowchart is implemented when the main controller 201 loads a control program stored in the ROM 210 onto a work area of the RAM 211, and executes the developed program. FIG. 4 shows the outer appearance of an operation unit 215 of the thermal printer according to this embodiment. On the operation unit 215, a power button 401 used to turn on/off the power supply of the printer, a print/stop button 406 used to issue image forming execution/stop instruction, and a liquid crystal screen 404 used to display a GUI screen are arranged.

Referring to FIG. 3, when the user turns on the power supply by pressing the power button 401 in step S301, the process advances to step S302, and the main controller 201 controls the cartridge detection sensor 212 to determine whether or not a cartridge is detected. If no cartridge is detected, the process advances to step S303, and the main controller 201 displays a message which prompts the user to attach a cartridge on the liquid crystal screen 404.

If a cartridge is detected in step S302, the process advances to step S304, and the main controller 201 controls the paper detection sensor 213 to determine whether or not printing paper remains in the printer engine. If remaining paper is detected, the main controller 201 executes remaining paper processing in step S305, as will be described in detail later.

On the other hand, if no remaining paper is detected in step S304 or if the remaining paper processing in step S305 is properly complete, the process advances to step S306.

In step S306, the main controller 201 reads out image data via the memory I/F 216 or image data input unit 219, and displays the readout image data on the liquid crystal screen 404. In this image display state, the user selects an image to be formed and makes image forming settings by operating a four-way selector/SET button 405. The user can switch the current screen to a trimming/editing screen of image data by pressing an edit button 410, and can determine a trimming size of an image by pressing a zoom button 408 or pan button 407. Also, the user can display information such as a file name and size of designated image data by pressing a display button 409. The user can switch the current screen to a selection screen of edit functions such as creation of a calendar, that of a multi-layout (to lay out a plurality of image data in a given pattern), that of a multi-aspect image (for example, an image having an aspect ratio of 1:1, 4:3, 3:2, 16:9, or the like), and so forth by pressing a fun button 402.

In this way, after the user selects an image to be formed and completes various image forming settings in a print image selection operation in step S306, when he or she presses the print/stop button 406 in step S307, the main controller 201 starts image forming processing.

<Image Forming Operation>

An image forming operation (printing control processing) by the thermal printer according to this embodiment will be described below with reference to FIGS. 1 and 5. Note that processing shown in FIG. 5 is implemented when the main controller 201 develops a control program stored in the ROM 210 onto a work area of the RAM 211, and executes the developed program.

Referring to FIG. 5, in step S508, the main controller 201 pulls out the printing paper 112 from the roll paper 101 by rotating the roll paper shaft 102, and conveys the leading end of the printing paper 112 to the grip roller 103. In step S509 and subsequent steps, the printing paper 112 is conveyed by rotation of the grip roller 103 which is driven and controlled by the paper conveyance motor 203.

In step S509, the main controller 201 detects the leading end of the printing paper 112 conveyed upon rotation of the grip roller 103 using the paper detection sensor 114. After the paper detection sensor 114 detects the leading end of the printing paper 112, a conveyance position of the printing paper 112 is controlled in an open loop.

Figure 6:
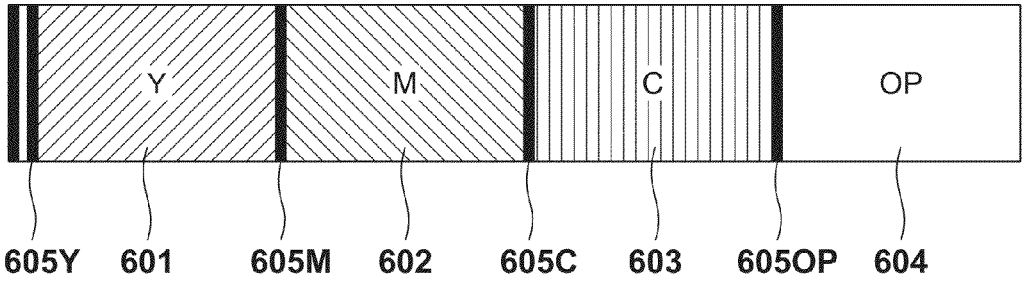
FIG. 6 is a view showing an ink sheet for the thermal printer.

In step S510, the main controller 201 further rotates the grip roller 103, so that the printing paper 112 reaches the curl correction unit 105. The printing paper 112 whose curl is corrected by the curl correction unit 105 is conveyed to the thermal head 109 and platen roller 106, and the ink sheet 113 passes through a gap between the thermal head 109 and printing paper 112. As shown in FIG. 6, the ink sheet 113 includes yellow (Y), magenta (M), and cyan (C) sublimation dye ink portions 601 to 603 and a hot-melt ink OP layer 604. Then, sets each including the sublimation ink portions and hot-melt ink portion, which are arrayed frame-sequentially, are periodically arranged. Also, sheet top position detecting markers 605Y, 605M, 605C, and 6050P of the ink sheet 113 are arranged between the neighboring sublimation ink portions and between the sublimation ink portion and hot-melt ink portion. The printing paper 112 which has passed through the platen roller 106 reaches the discharge rollers 107, and is conveyed to an image forming start position by the thermal head 109.

Figure 7A:
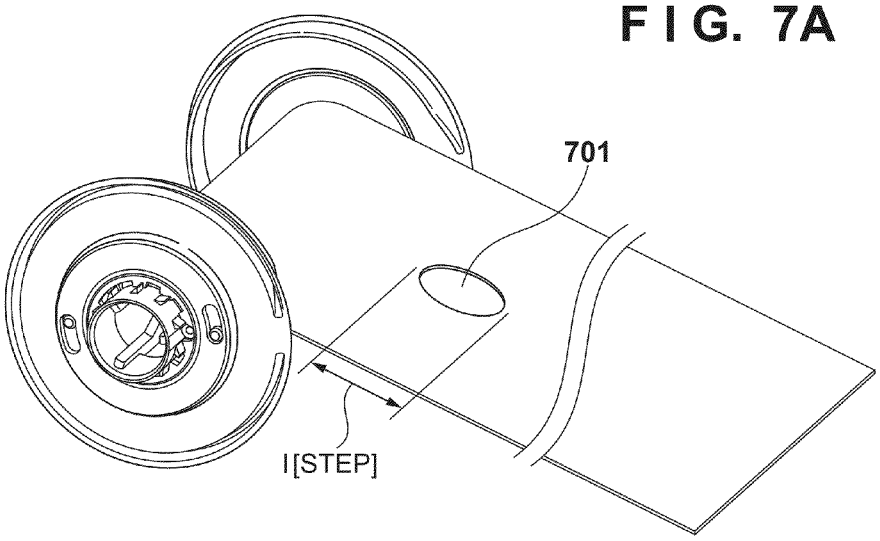
FIGS. 7A and 7B are views showing examples of to-be-detected portions of a terminal end of printing paper for the thermal printer.
Figure 7B:
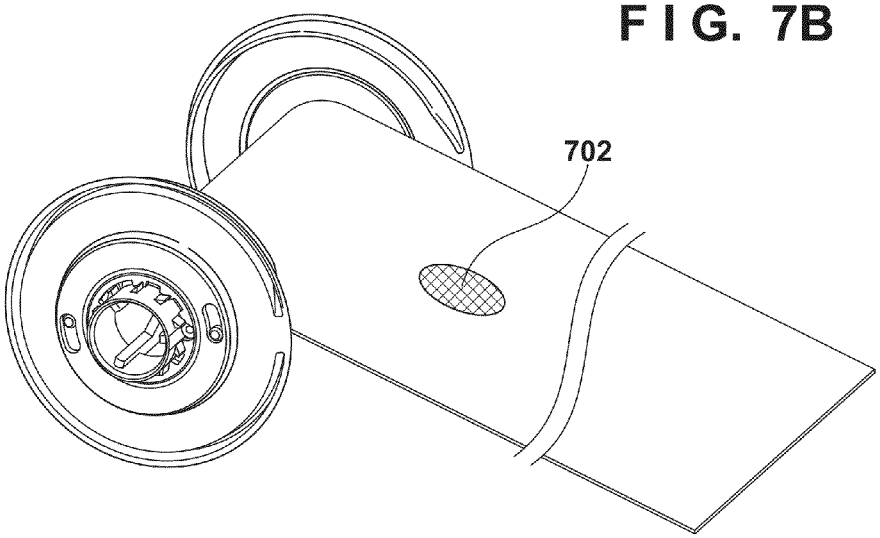

In step S511, the main controller 201 detects the terminal end of the roll paper 101. As the terminal end of the roll paper 101, a terminal end hole 701 shown in FIG. 7A or a dedicated terminal end marker 702 shown in FIG. 7B is detected by a dedicated sensor or the sensor used to detect the leading end of the printing paper. This embodiment will explain a case in which the terminal end position of the roll paper 101 is determined by detecting the terminal end hole 701 shown in FIG. 7A by the paper detection sensor 114. That is, when the detection result of the paper detection sensor 114 changes from a "paper detected" state to a "no paper detected" state during the pulling-out operation of the printing paper 112, it is determined that the terminal end of the printing paper is detected. When the terminal end of the roll paper 101 is detected by the paper detection sensor 114 while the printing paper is fed out to the image forming start position, the printing paper 112 is accommodated, and a message which prompts the user to exchange paper is displayed on the liquid crystal screen 404.

If no terminal end of the printing paper is detected in step S511, the process advances to step S512, and the main controller 201 conveys the printing paper 112 to the image forming start position.

In step S513, the main controller 201 sets sheet top position of the Y ink sheet. In this case, the ink sheet 113 is taken up until the marker 605Y (only the Y marker is identifiable as a double line) of the Y sheet portion is detected by the marker detection sensor 115. Upon completion of the sheet top position setting of the Y ink sheet, the thermal head 109, which stands by during conveyance of the printing paper and sheet top position setting of the ink sheet, is brought into pressure contact with the platen roller 106 while clamping the printing paper 112 and ink sheet 113.

In step S514, the main controller 201 reads out image data via the memory I/F 216 or image data input unit 219, and converts the image data in the image buffer memories 220Y, 220M, and 220C into thermal head driving data (image forming data). Then, the driver controller 221 controls the thermal head driving circuit 222 according to the thermal head driving data, thereby performing image forming. Thus, the ink sheet 113 of each color is heated according to the image forming data, and a dye is sublimated and fixed onto the printing paper 112, thereby forming (transferring) an image for one line. Since an image forming operation for the predetermined number of lines is performed while conveying the printing paper 112 upon rotation of the grip roller 103, a Y image is formed. Note that, in step S514, the printing paper 112 is conveyed in the direction of the arrow A in FIG. 1 by rotating the grip roller 103 by the number of steps corresponding to an image size. At this time, the printing paper 112 is in pressure contact with the curl correction unit 105 and is handled while being clamped between the thermal head 109 and platen roller 106, thereby correcting a curl of the printing paper 112.

Upon completion of image forming of the Y image, the process advances to step S515, and the main controller 201 moves the thermal head 109 to the retracted position, and sets the printing paper 112 and ink sheet 113 to be freely movable. Then, the main controller 201 rotates the grip roller 103 in a direction opposite to that of an image forming operation, and conveys the printing paper 112 in the direction of the arrow B until the transfer start position of the first image on the printing paper 112 matches positions of the heat generating members of the thermal head 109.

In step S516, the main controller 201 sets sheet top position of the M ink sheet by detecting the marker 605M of the M ink sheet portion by the marker detection sensor 115 while taking up the ink-sheet take-up bobbin 108.

In step S517, the main controller 201 executes an image forming operation of an M image using the M ink sheet portion as in step S514 so as to overlap the image portion formed using the Y ink sheet portion. Likewise, in steps S518 to S523, image forming operations of a C image and OP layer are performed so as to overlap the image portion formed using the Y ink sheet portion. Note that the OP layer assumes a role of formation of a protection layer which coats the surface of the color image on the printing paper on which the Y, M, and C images have been transferred.

Upon completion of the image forming operation of the OP layer in step S523, the process advances to step S524, and the main controller 201 moves the thermal head 109 to the retracted position and rotates the grip roller 103 in a direction opposite to that in the image forming operation. The main controller 201 conveys the printing paper 112 in the direction of the arrow B until a cutting position of the printing paper 112 reaches a position of the cutter 111. In step S525, the main controller 201 executes cutting processing of the printing paper 112 by the cutter 111.

In step S526, the main controller 201 clamps the printing paper 112 cut in step S525 by the discharge roller pair 107, and conveys the printing paper 112 in the direction of the arrow B by rotating the paper conveyance motor 203, thereby discharging the image-forming processed printing paper 112 outside the printer.

Finally, in step S527, the main controller 201 winds up the remaining printing paper 112 by rotating the grip roller 103 and roll paper shaft 102.

With the aforementioned processing, the image forming operations are complete.

<Remaining Paper Processing 1>

The first example of the remaining paper processing in step S305 in FIG. 3 will be described below with reference to FIG. 8 and FIGS. 9A and 9B. FIGS. 9A and 9B show positions of the remaining paper at the activation timing of the thermal printer of this embodiment.

Figure 8:
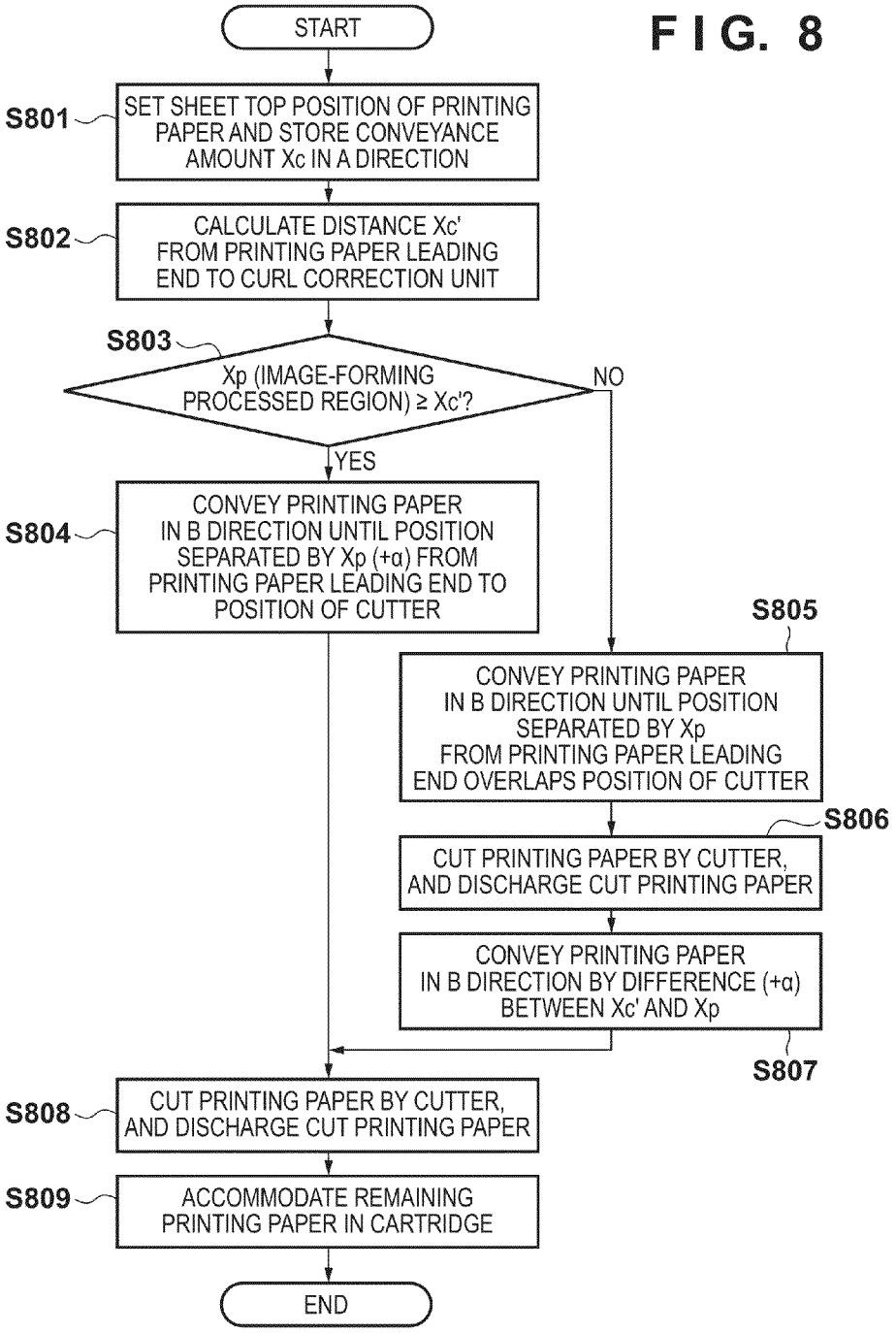
FIG. 8 is a flowchart showing a first example of remaining paper processing according to the embodiment.
Figure 9A:
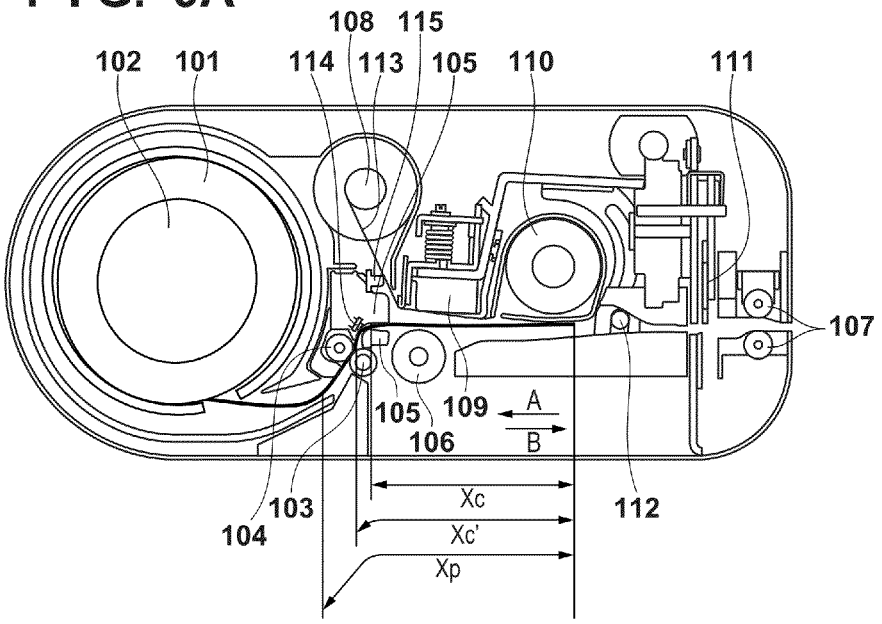
FIGS. 9A and 9B are views for explaining the remaining paper processing shown in FIG. 8.
Figure 9B:
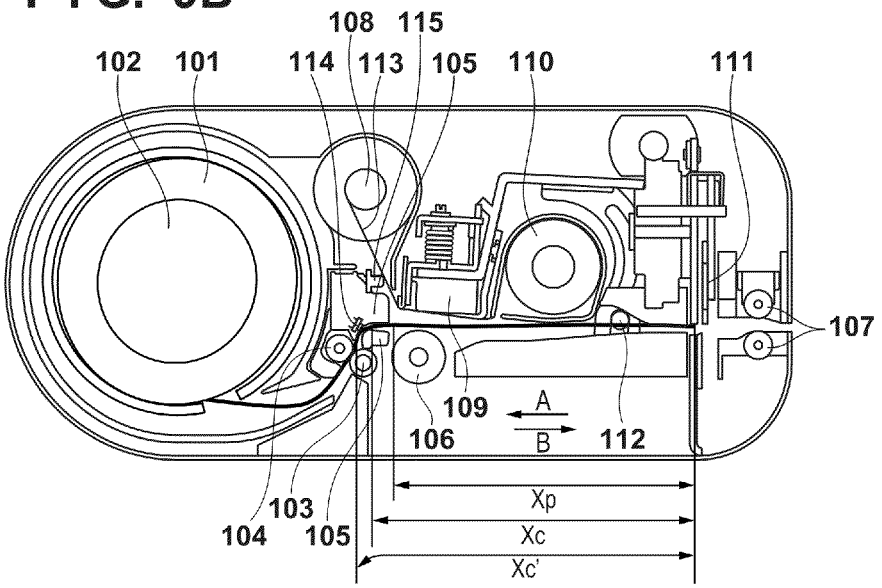

Referring to FIG. 8, in step S801, the main controller 201 conveys the printing paper 112 in the printer engine to the position of the paper detection sensor 114 in the direction of the arrow A by rotating the grip roller 103. At this time, a driving step count of the paper conveyance motor 203 from the beginning to the end of driving is counted by the main controller 201. Let Xc [steps] be the driving step count. The count value is temporarily stored in the RAM 211.

In step S802, the main controller 201 adds a step count m [steps] stored in the ROM 210 and required to convey the printing paper from the curl correction unit 105 to the paper detection sensor 114 to the Xc [steps]. Thus, a step count Xc' [steps] required to convey the printing paper leading end position at the activation timing to the curl correction unit 105 is calculated.

Note that when the curl correction unit 105 includes the paper detection sensor 114, Xc' equals Xc, and the process of step S802 can be omitted.

In step S803, the main controller 201 compares a first distance Xc' [steps] with a second distance Xp [steps] stored in the ROM 210. Note that Xp [steps] corresponds to a driving step count of the motor 203 required to convey the printing paper by an image-forming processed object length in the previous image forming operation.

As a method for calculation of the image-forming processed object length in the previous image forming operation, a method of storing information of the image-forming processed object length in the RAM 211 or the like, and reading out that information before step S803 is available. On the other hand, when such storage cannot be made or when it has failed, a maximum image forming length stored in the ROM 210 is read out as the image-forming processed object length in the previous image forming operation based on the detection result of the cartridge type at the activation timing before step S803. Alternatively, in case of a printer which creates an image-forming processed object having a margin portion at a leading end portion of printing paper, Xp [steps] has to be set to include the length of the margin portion in addition to the aforementioned image forming length.

If the main controller 201 determines in step S803 that Xp [steps]≥Xc' [steps], the process advances to step S804. When Xp [steps]≥Xc'[steps], since an image-forming processed region includes a portion formed with a curl, as shown in FIG. 9A, the image-forming processed region is clipped to also clip the curl portion.

Hence, in step S804, the main controller 201 conveys the printing paper 112 until the image forming trailing end position overlaps the cutter position, so as to clip the image-forming processed region. Let I [steps] be a driving step count of the paper conveyance motor 203 required to convey the printing paper by a spacing between the paper detection sensor 114 and cutter 111, the paper conveyance motor 203 is driven by (Xp+I) [steps] in step S804. At this time, the printing paper may be conveyed more by a slight step count α [steps] under the assumption of a feed precision error by the paper conveyance motor 203, a detection position error of the paper detection sensor 114, an attachment error, and the like. After completion of paper conveyance in step S804, the process advances to step S808.

On the other hand, if the main controller 201 determines in step S803 that Xp [steps]<Xc' [steps], the process advances to step S805. When Xp [steps]<Xc' [steps], since the curl portion includes an image-forming processed region, the image-forming processed region can be clipped by clipping the curl portion, as shown in FIG. 9B. Since a portion between the trailing end of the image-forming processed region and the curl portion has not undergone any image forming operation, if a portion from the leading end of the printing paper until the curl portion is clipped, a long image-forming processed object having a margin on its trailing end portion is discharged. In order to remove an unnecessary margin portion, it is desirable to separately discharge a portion from the leading end of the printing paper to the trailing end of the image-forming processed region and that from the trailing end of the image-forming processed region to the curl portion.

Hence, in step S805, the main controller 201 conveys the printing paper 112 in the direction of the arrow B until the trailing end of the image-forming processed region overlaps the position of the cutter 111, so as to clip the image-forming processed region. That is, in step S805, the paper conveyance motor 203 is driven by (Xp+I) [steps] as in step S804. After completion of paper conveyance in step S805, the process advances to step S806.

In step S806, the main controller 201 cuts the printing paper 112 using the cutter 111, and discharges the image-forming processed printing paper 112 outside the printer by rotating the discharge rollers 107. After completion of step S806, the process advances to step S807.

In step S807, the main controller 201 conveys the printing paper 112 in the direction of the arrow B until the curl portion overlaps the position of the cutter 111, so as to clip the curl portion. Since the printing paper 112 is already conveyed in the direction of the arrow B until the trailing end position of the image-forming processed region overlaps the position of the cutter 111 in step S805, the printing paper 112 is conveyed in the direction of the arrow B by a length from the trailing end position of the image-forming processed region to the curl portion in step S807. That is, the paper conveyance motor 203 is driven by (Xc'−Xp) [steps] in step S807. In this step, likewise, the printing paper may also be conveyed more by the slight step count α [steps]. On the other hand, when the single paper conveyance motor 203 simultaneously rotates the grip roller 103 and discharge rollers 107, it has to be driven in step S807 by subtracting a driven amount required to discharge the printing paper 112 in step S806. After completion of step S807, the process advances to step S808.

In step S808, the main controller 201 cuts the printing paper 112 using the cutter 111, and discharges the image-forming processed printing paper 112 outside the printer by rotating the discharge rollers 107.

Finally, in step S809, the main controller 201 winds up the remaining printing paper 112 by rotating the grip roller 103 and roll paper shaft 102. With the aforementioned processing, the remaining paper processing ends.

The remaining paper processing can prevent a re-image forming operation from a position on the image-forming processed printing paper in a next image forming operation while suppressing wasteful use of the printing paper, and can also suppress deterioration of image forming quality caused by a curl portion in the next image forming operation by a minimum printing paper clipping amount.

In this embodiment, when the curl portion includes the image-forming processed region, the printing paper is cut twice, that is, by a portion from the leading end of the printing paper to the trailing end of the image-forming processed region and that from the trailing end of the image-forming processed region to the curl portion. However, in consideration of shortening of a processing time and the like, a portion from the leading end of the printing paper to the curl region may be cut once. In this case, the driving amount of the paper conveyance motor 203 in step S805 is (Xc'+I) [steps], and the need for the processes of steps S806 and S807 can be obviated.

In this embodiment, the local curl portion in the opposing direction by the curl correction unit 105 is removed. Also, a region formed with projection marks by the grip roller may be removed. In this case, the aforementioned processing can be executed intact by replacing the curl correction unit 105 of this embodiment by the grip roller 103. That is, the driving step count m [steps] of the paper conveyance motor 203 used in step S802 can be replaced by a driving step count n [steps] of the paper conveyance motor 203 required to convey the printing paper from the grip roller 103 to the paper detection sensor 114.

<Remaining Paper Processing 2>

The second example of the remaining paper processing in step S305 in FIG. 3 will be described below with reference to FIGS. 10 to 12B. FIGS. 11A and 11B and FIGS. 12A and 12B show positions of the remaining paper at the activation timing of the thermal printer of this embodiment.

Figure 10:
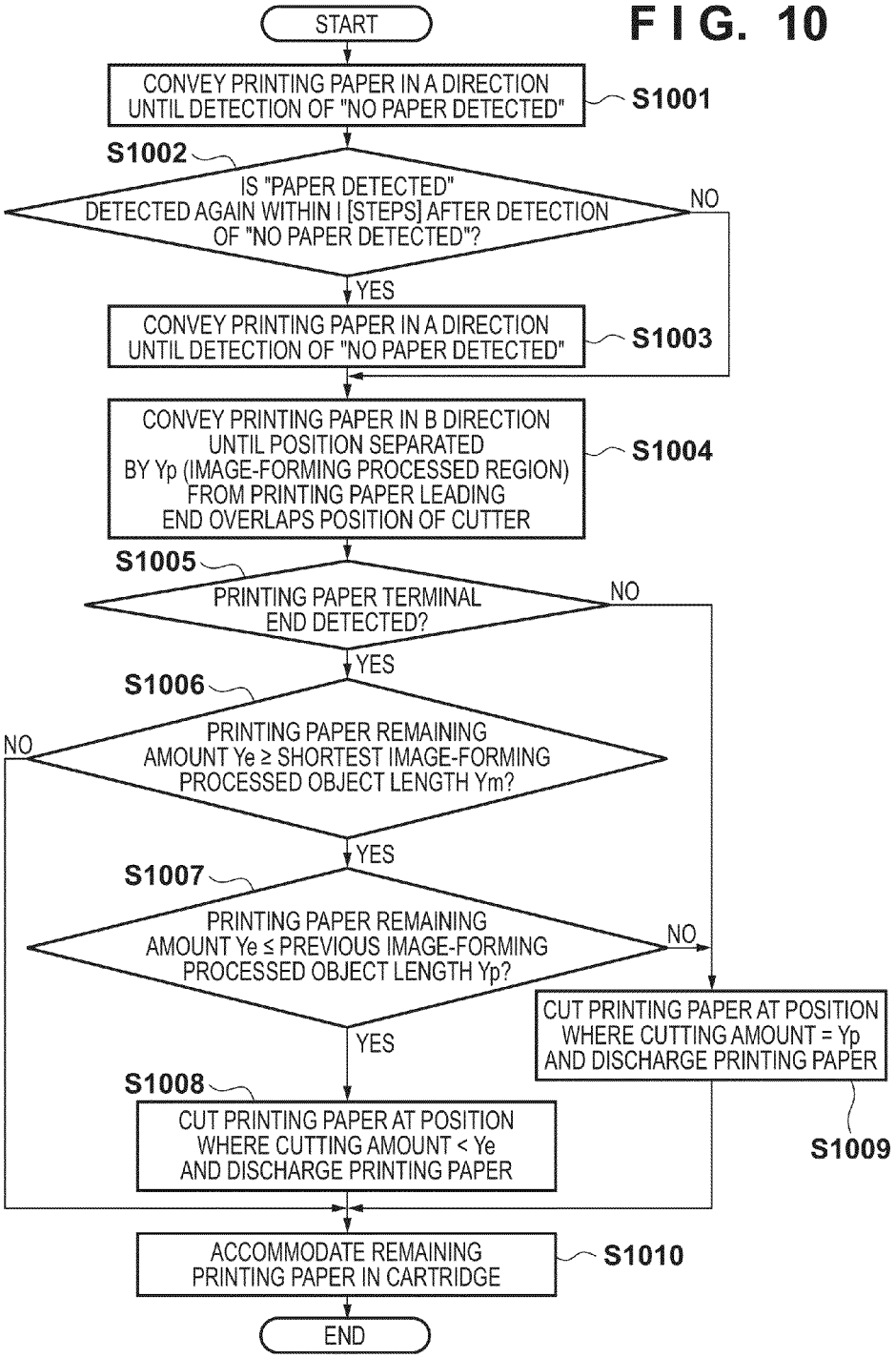
FIG. 10 is a flowchart showing a second example of remaining paper processing according to the embodiment.

Referring to FIG. 10, in step S1001, the main controller 201 conveys the printing paper 112 in the printer engine in the direction of the arrow A by rotating the grip roller 103. At this time, the paper detection sensor 114 monitors whether or not the printing paper is detected, and if the "paper detected" state is switched to the "no paper detected" state, the process advances to step S1002.

In step S1002, the main controller 201 further conveys the printing paper in the direction of the arrow A by I [steps]. Note that I [steps] is the driving step count of the paper conveyance motor 203 required to convey the printing paper by a length slightly larger than the width of the terminal end hole 701 in the paper conveyance direction, as shown in FIGS. 7A and 7B. In step S1002, the main controller 201 checks the output of the paper detection sensor 114 again after conveyance by l [steps].

If the output of the paper detection sensor 114 returns to "paper detected" in step S1002, the process advances to step S1003. In this case, since the terminal end hole 701 is located between the printing paper leading end position at the activation timing and the paper detection sensor 114, the main controller 201 executes the same operation as in step S1001 in step S1003. That is, in step S1003, the paper detection sensor 114 monitors whether or not the printing paper is detected while conveying the printing paper 112 in the engine in the direction of the arrow A, and conveyance is continued until a timing at which the "paper detected" state is switched to the "no paper detected" state. Since the second detection of the "no paper detected" state means that the leading end of the printing paper has passed by the paper detection sensor 114, the process advances to step S1004.

On the other hand, if the detection result "no paper detected" of the paper detection sensor 114 is still obtained after conveyance by I [steps] in step S1002, the leading end of the printing paper has passed by the paper detection sensor 114 in place of detection of the terminal end hole 701 at the "no paper detected" detection timing. In this case as well, the process advances to step S1004.

In step S1004, the main controller 201 conveys the printing paper in the direction of the arrow B until a position separated by Yp from the leading end of the printing paper overlaps the position of the cutter 111. Note that Yp is the image-forming processed object length in the previous image forming operation. As a method for calculation of the image-forming processed object length in the previous image forming operation, a method of storing information of the image-forming processed object length in the RAM 211 or the like, and reading out that information before step S1004 is available. On the other hand, when such storage in the RAM 211 cannot be made or when it has failed, a maximum image forming length stored in the ROM 210 is read out as the image-forming processed object length in the previous image forming operation based on the detection result of the cartridge type at the activation timing before step S1004. Alternatively, in case of a printer which creates an image-forming processed object having a margin portion at a leading end portion of printing paper, Xp [steps] has to be set to include the length of the margin portion in addition to the aforementioned image forming length.

The main controller 201 determines in step S1005 whether or not the detection state of the printing paper by the paper detection sensor 114 is temporarily switched from the "no paper detected" state to the "paper detected" state, and is then switched from the "paper detected" state to the "no paper detected" state again in the middle of step S1004. Note that the reason why the "no paper detected" state is temporarily switched to the "paper detected" state is that the leading end of the printing paper is conveyed to a point on the upstream of the paper detection sensor 114 (on the side of the direction of the arrow A) in step S1001 or S1003. That is, this "paper detected" state is equivalent to detection of the leading end of the printing paper. In step S1005, the main controller 201 counts driving steps t [steps] of the paper conveyance motor 203 from detection of the leading end of the paper until the terminal end hole 701 is detected.

Figure 11A:
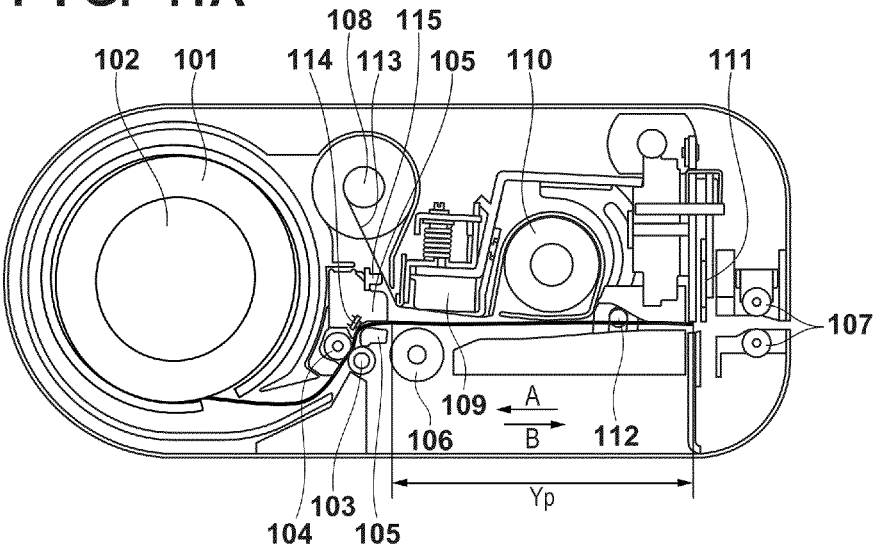
FIGS. 11A and 11B are views for explaining the remaining paper processing shown in FIG. 10.

If the conveyance is complete without being switched from the "paper detected" state in step S1005, since no terminal end of the printing paper is detected, the process advances to step S1009. FIG. 11A shows the position of the remaining paper at the activation timing in this case.

On the other hand, if the "no paper detected" state is detected in step S1005, the process advances to step S1006. In step S1006, the main controller 201 compares a conveyance amount Ye calculated from the driving steps t [steps] of the paper conveyance motor 203 from the leading end of the printing paper to the terminal end hole 701 (to be referred to as a "remaining amount Ye of printing paper" hereinafter) with Ym. Note that Ym indicates a shortest image-forming processed object length which can be printed by the printer. In order to calculate the shortest image-forming processed object length, a shortest image forming length stored in the ROM 210 need only be read out before step S1006 based on the detection result of the cartridge type at the activation timing. Alternatively, in case of a printer which creates an image-forming processed object having a margin portion at a leading end portion of printing paper, Ym has to be set to include the length of the margin portion in addition to the aforementioned image forming length. On the other hand, in a printer which cannot perform image forming operations of image-forming processed objects of a plurality of image forming lengths, Yp equals Ym.

Figure 11B:
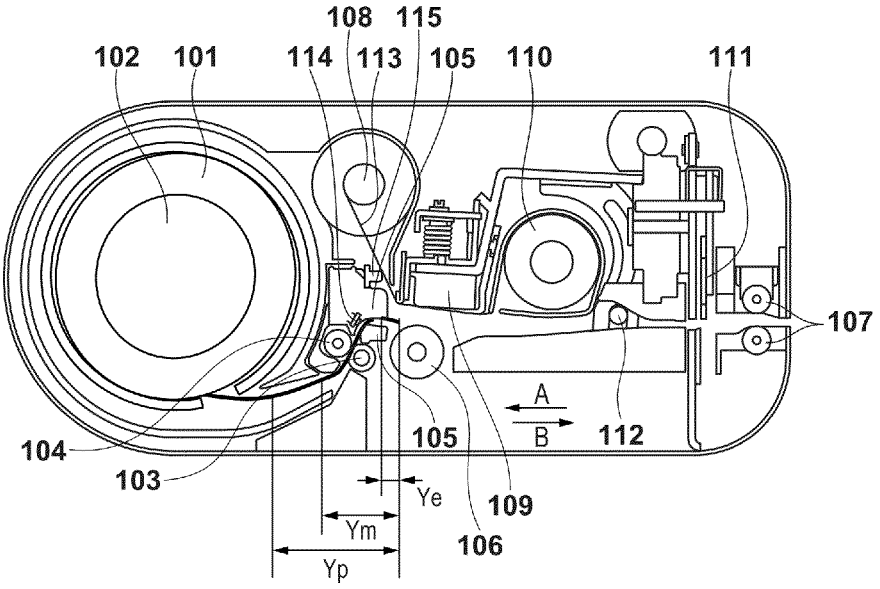

If the remaining amount Ye of the printing paper <the shortest image-forming processed object length Ym in step S1006, the process jumps to step S1010. FIG. 11B shows the position of the remaining paper at the activation timing in this case. In this case, since the remaining amount of the printing paper is small, the printing paper may not be pulled out by Yp. Also, since the remaining amount Ye of the printing paper <the shortest image-forming processed object length Ym, an image is unlikely to be formed on the remaining paper. For this reason, the remaining paper is not cut, and the printing paper 112 is accommodated in the cartridge in step S1010. After the printing paper 112 is accommodated in the cartridge, a message which prompts the user to exchange printing paper may be displayed on the liquid crystal screen 404, or the processing may end without prompting the user to exchange printing paper, so as to commonize processing with other cases to be described later. Even in this case, at the paper feed timing (step S511 in FIG. 5) before the next image forming operation, since the terminal end of the printing paper is detected, a problem of a detection failure of the terminal end of the printing paper never occurs.

On the other hand, if the remaining amount Ye of the printing paper ≥the shortest image-forming processed object length Ym in step S1006, the process advances to step S1007. In step S1007, the main controller 201 compares the remaining amount Ye of the printing paper with the previous image-forming processed object length Yp.

Figure 12A:
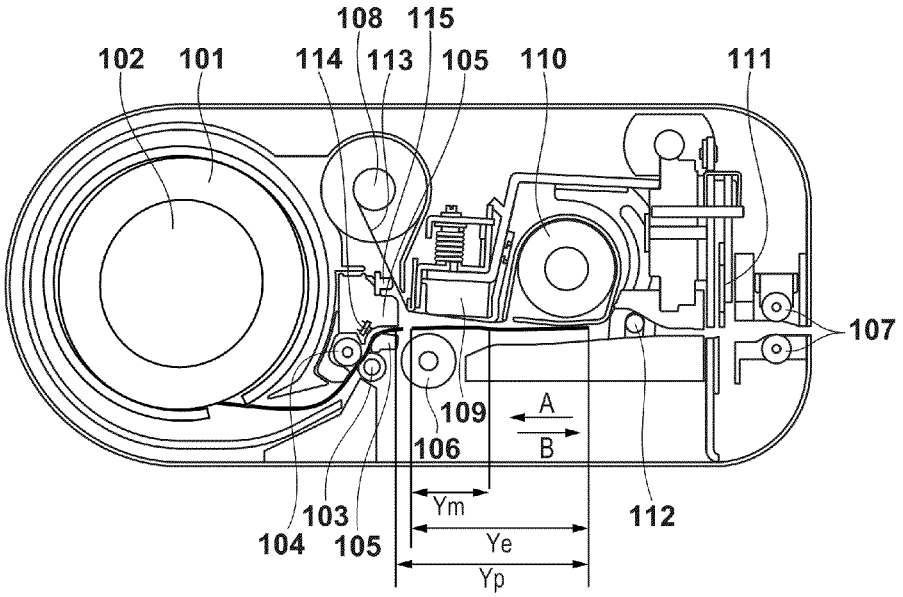
FIGS. 12A and 12B are views for explaining the remaining paper processing shown in FIG. 10.

If the remaining amount Ye of the printing paper≤the the previous image-forming processed object length Yp in step S1007, the process advances to step S1008. FIG. 12A shows the position of the remaining paper at the activation timing in this case.

In step S1008, the main controller 201 cuts the printing paper 112 using the cutter 111 at a position at which a cutting amount is less than Ye and is larger than (Ye−Ym), so as not to cut the terminal end hole 701 by mistake. The reason why the printing paper is cut at the position at which the cutting amount is larger than (Ye−Ym) is that it is not guaranteed that the clipped remaining printing paper does not undergo any image forming operation. When the printing paper is cut at this position, since the remaining amount Ye of the printing paper is less than the shortest image-forming processed object length Ym, even when an image forming operation of the shortest image-forming processed object length Ym is attempted at the next image forming timing, the terminal end of the printing paper can be detected at the paper feed timing before the image forming operation (step S511 in FIG. 5). After completion of the discharge operation of the printing paper 112, the process advances to step S1010, and the remaining printing paper is accommodated in the cartridge. After the printing paper 112 is accommodated in the cartridge, a message which prompts the user to exchange printing paper may be displayed on the liquid crystal screen 404, or the processing may end without prompting the user to exchange printing paper, so as to commonize processing with other cases to be described later.

Figure 12B:
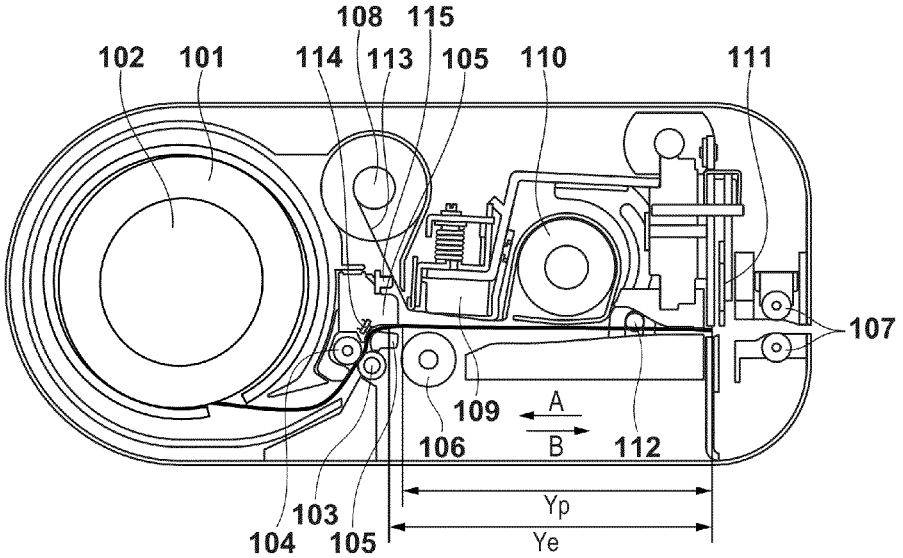

On the other hand, if the remaining amount Ye of the printing paper is larger than the previous image-forming processed object length Yp in step S1007, the process advances to step S1009. FIG. 12B shows the position of the remaining paper at the activation timing in this case. Step S1009 is executed after step S1005 or S1007. In either case, the printing paper 112 is cut using the cutter 111 at a position corresponding to a cutting amount=Yp so as to prevent the terminal end hole 701 from being cut by the cutter 111 by mistake. Note that the printing paper may be cut by a length slightly larger than Yp under the assumption of a feed precision error by the paper conveyance motor 203, a detection position error of the paper detection sensor 114, an attachment error, and the like. However, the terminal end hole 701 does not have to be cut by slightly increasing the cutting amount, as a matter of course. After the printing paper 112 is cut, the cut printing paper 112 is discharged, and the process advances to step S1010.

In step S1010, the main controller 201 accommodates the remaining printing paper in the cartridge. After the printing paper 112 is accommodated in the cartridge, since an image forming operation is likely to be executed depending on an image forming length even via step S1007, it is desirable to end processing without prompting the user to exchange printing paper.

With the aforementioned processing, the remaining paper processing ends.

The remaining paper processing can prevent a re-image forming operation from a position on image-forming processed printing paper in the next image forming timing, and can also prevent a terminal end detection portion of the roll paper from being clipped by mistake. Furthermore, the roll paper having the small remaining amount can be prevented from being pulled out forcedly.

In this embodiment, a portion from the leading end of the printing paper to the trailing end of the image-forming processed region or to a position before the terminal end hole is cut by a single cutting operation. However, the portion of the printing paper need not always be cut by the single cutting operation. For example, in a printer in which a margin portion is set at the leading end of the printing paper, and is discarded as waste in a normal image forming operation, the printing paper may be cut by a single cutting operation at the margin portion at the leading end of the printing paper by the remaining paper processing of this embodiment.

Note that the printing paper of this embodiment is not limited to paper, but the present invention is applicable to print sheets such as plastic films which are made up of other materials.

This embodiment has exemplified the case in which the image forming apparatus of the present invention is applied to a thermal transfer or sublimation type thermal printer. However, the present invention is not limited to the thermal printer. For example, in an inkjet printer, adhesion is never caused by a re-image forming operation on image-forming processed printing paper, but deterioration of image forming quality due to the re-image forming operation on the image-forming processed printing paper cannot be avoided. Hence, by practicing the remaining paper processing of the present invention, deterioration of image forming quality can be avoided. In this manner, the present invention is applicable to various types of image forming apparatuses using roll paper.

This embodiment has explained the case in which the sensor required to set the sheet top position of the printing paper is common to that required to detect the terminal end of the printing paper. However, the common sensor need not always be used.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-109927, filed May 11, 2012, which is hereby incorporated by reference herein in its entirety.

What is claimed is:

1. An image forming apparatus comprising:

an accommodation unit configured to accommodate a continuous printing sheet wound in a roll shape;

a conveyance unit configured to pull out and convey the printing sheet from said accommodation unit;

a printing unit configured to perform image forming processing on the printing sheet which is conveyed by said conveyance unit to an image forming start position;

a cutting unit configured to cut the printing sheet after completion of the image forming processing at a predetermined cutting position; and a processing unit configured to execute, when a printing sheet remaining on a conveyance path is detected at an activation timing, processing for removing the remaining printing sheet, wherein said processing unit controls said conveyance unit to convey the printing sheet at the activation timing to detect a leading end of the printing sheet, compares a first distance from the leading end to a portion which was located at a curl correction unit before the activation with a second distance from the leading end, which distance is required for image forming processing set before the activation, and sets a larger distance of the first and the second distances as a cutting position of the remaining printing sheet.

2. The apparatus according to claim 1, wherein when the first distance is larger than the second distance, said processing unit sets the first distance as the cutting position so as to cut a printing sheet until the second distance and then cut the printing sheet until the curl correction unit by said cutting unit.

3. The apparatus according to claim 1, wherein said processing unit controls said conveyance unit to discharge the printing sheet cut by said cutting unit, and accommodates a remaining portion of the printing sheet in said accommodation unit.

4. The apparatus according to claim 1, further comprising:

a determination unit configured to determine a previous image-forming processed length, wherein said processing unit sets a cutting position of the printing sheet according to the previous image-forming processed length determined by said determination unit at the activation timing.

5. The apparatus according to claim 4, further comprising:

a storage unit configured to store information of a previous image-forming processed region.

6. The apparatus according to claim 1, further comprising:

a detection unit configured to detect a to-be-detected portion formed at a terminal end of the image-forming processed printing sheet, wherein when the to-be-detected portion is detected during conveyance of the printing sheet to the cutting position, said processing unit changes the setting of the cutting position so as not to cut the to-be-detected portion.

7. The apparatus according to claim 6, wherein when a distance from the leading end to the to-be-detected portion is shorter than a shortest length that allows the image forming processing, said processing unit accommodates the remaining portion of the printing sheet in said accommodation unit without cutting the printing sheet.

8. The apparatus according to claim 6, wherein when a distance from the leading end to the to-be-detected portion is shorter than the second distance, said processing unit sets a cutting position to be a position shorter than the distance from the leading end to the to-be-detected portion.

9. The apparatus according to claim 1, wherein said printing unit executes the image forming processing by transferring an ink onto a printing sheet by a thermal head.

10. A control method of an image forming apparatus having: an accommodation unit configured to accommodate a continuous printing sheet wound in a roll shape; a conveyance unit configured to pull out and convey the printing sheet from the accommodation unit; a printing unit configured to perform image forming processing on the printing sheet which is conveyed by the conveyance unit to an image forming start position; and a cutting unit configured to cut the printing sheet after completion of the image forming processing at a predetermined cutting position, the method comprising:

a remaining sheet processing step of executing, when a printing sheet remaining on a conveyance path is detected at an activation timing, processing for removing the remaining printing sheet, wherein in the remaining sheet processing step, the conveyance unit is controlled to convey the printing sheet at the activation timing to detect a leading end of the printing sheet, a first distance from the leading end to a portion which was located at a curl correction unit before the activation is compared with a second distance from the leading end, which distance is required for image forming processing set before the activation, and a larger distance of the first and the second distances is set as a cutting position of the remaining printing sheet.

11. The method according to claim 10, wherein in the remaining sheet processing step, when the first distance is larger than the second distance, the first distance is set as the cutting position so as to cut a printing sheet until the second distance and then cut the printing sheet until the curl correction unit by the cutting unit.

12. The method according to claim 10, wherein in the remaining sheet processing step, the printing sheet cut by the cutting unit is discharged by the conveyance unit, and a remaining portion of the printing sheet is accommodated in the accommodation unit.

13. The method according to claim 10, further comprising:

a determination step of determining a previous image-forming processed length, wherein in the remaining sheet processing step, a cutting position of the printing sheet is set according to the previous image-forming processed length determined in the determination step at the activation timing.

14. The method according to claim 13, further comprising:

a storage step of storing information of a previous image-forming processed region in a storage unit.

15. The method according to claim 10, further comprising:

a detection step of detecting a to-be-detected portion formed at a terminal end of the image-forming processed printing sheet, wherein in the remaining sheet processing step, when the to-be-detected portion is detected during conveyance of the printing sheet to the cutting position, the setting of the cutting position is changed so as not to cut the to-be-detected portion.

16. The method according to claim 15, wherein in the remaining sheet processing step, when a distance from the leading end to the to-be-detected portion is shorter than a shortest length that allows the image forming processing, the remaining portion of the printing sheet is accommodated in the accommodation unit without cutting the printing sheet.

17. The method according to claim 15, wherein in the remaining sheet processing step, when a distance from the leading end to the to-be-detected portion is shorter than the second distance, a cutting position is set to be a position shorter than the distance from the leading end to the to-be-detected portion.

18. The method according to claim 10, wherein the printing unit executes the image forming processing by transferring an ink onto a printing sheet by a thermal head.

19. A non-transitory computer-readable storage medium storing a program for causing a computer to execute the control method according to claim 10.

* * * * *